US009704435B2

(12) United States Patent
Chen et al.

(10) Patent No.: US 9,704,435 B2
(45) Date of Patent: Jul. 11, 2017

(54) ORGANIC LIGHT EMITTING DIODE PIXEL COMPENSATION CIRCUIT, AND DISPLAY PANEL AND DISPLAY DEVICE CONTAINING THE SAME

(71) Applicants: Shanghai Tianma AM-OLED Co.,Ltd, Shanghai (CN); Tianma Micro-Electronics Co., Ltd., Shenzhen (CN)

(72) Inventors: Dan Chen, Shanghai (CN); Dong Qian, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 226 days.

(21) Appl. No.: 14/536,492

(22) Filed: Nov. 7, 2014

(65) Prior Publication Data

US 2015/0371586 A1 Dec. 24, 2015

(30) Foreign Application Priority Data

Jun. 23, 2014 (CN) ..... 2014 1 0284428

(51) Int. Cl.

| | |
|---|---|
| ***G09G 3/30*** | (2006.01) |
| ***G09G 3/3258*** | (2016.01) |
| ***G09G 3/3233*** | (2016.01) |

(52) U.S. Cl.

CPC ..... *G09G 3/3258* (2013.01); *G09G 3/3233* (2013.01); *G09G 2300/0819* (2013.01); *G09G 2300/0842* (2013.01); *G09G 2300/0861* (2013.01); *G09G 2310/0251* (2013.01); *G09G 2320/045* (2013.01)

(58) Field of Classification Search

CPC ..... G09G 3/3208; G09G 2300/0819; G09G 2320/045; G09G 2310/0251

See application file for complete search history.

(56) References Cited

U.S. PATENT DOCUMENTS

2007/0063932 A1* 3/2007 Nathan ..... G09G 3/3233 345/76
2010/0026674 A1 2/2010 Araki
2013/0127924 A1* 5/2013 Lee ..... G09G 3/32 345/690

FOREIGN PATENT DOCUMENTS

CN 202855270 U 4/2013
EP 2306443 B1 4/2014

* cited by examiner

*Primary Examiner* — William Boddie
*Assistant Examiner* — Leonid Shapiro
(74) *Attorney, Agent, or Firm* — Anova Law Group, PLLC

(57) ABSTRACT

An Organic Light Emitting Diode pixel compensation circuit is disclosed. The circuit includes first through fifth transistors, and a storage capacitor. The first transistor is coupled to a first scan signal, a power supply voltage, and a first electrode of the storage capacitor. In addition, the second transistor is coupled to the first scan signal, a data signal, and the third transistor. The third transistor is coupled to the power supply voltage, and the fifth transistor. Furthermore, the fourth transistor is coupled to a second scan signal, the third transistor, and the storage capacitor, and fifth transistor is coupled to a light emitting signal, and the OLED. In addition, the storage capacitor is coupled to the fifth transistor, and a low-level signal and emits light based on a drive current generated by the third transistor.

20 Claims, 4 Drawing Sheets

ORGANIC LIGHT EMITTING DIODE PIXEL COMPENSATION CIRCUIT, AND DISPLAY PANEL AND DISPLAY DEVICE CONTAINING THE SAME

CROSS REFERENCE TO RELATED APPLICATIONS

This application claims the benefit of priority to Chinese Patent Application No. 201410284428.3, filed with the Chinese Patent Office on Jun. 23, 2014 and entitled "ORGANIC LIGHT EMITTING DIODE PIXEL COMPENSATION CIRCUIT, AND DISPLAY PANEL DEVICE CONTAINING THE SAME", the content of which is incorporated herein by reference in its entirety.

BACKGROUND OF THE INVENTION

At present, as shown in FIG. 1, an OLED pixel driving circuit generally contains a transistor T11, a transistor T12, a storage capacitor C11 and various drive signals for driving the OLED. A specific circuit connection is shown in FIG. 1. A working process of the pixel driving circuit comprises stages as follows.

In a signal write-in stage, in the case that a scan signal Scan is at a high-level, the transistor T12 is switched on, a data signal Data is input to a gate electrode of the transistor T11 through the transistor T12, hence the transistor T11 is switched on and a capacitance C11 is charged.

In a light emitting stage, the scan signal Scan is turned to be at a low-level, the transistor T12 is switched off, and discharging by the capacitance C11 enables the transistor T11 to be still in an on state. A power supply voltage PVDD continuously provides the OLED with a voltage until a next stage comes. The above cycle is repeated.

However, due to a limitation of a process level, during a manufacture of a transistor circuit of an OLED display, a drive current of the OLED display deviates and a panel displays abnormally due to a threshold voltage exists for a driving transistor.

BRIEF SUMMARY OF THE INVENTION

One inventive aspect is an Organic Light Emitting Diode pixel compensation circuit, configured to drive an Organic Light Emitting Diode (OLED) to emit light. The OLED pixel compensation circuit includes first, second, third, fourth, and fifth transistors, and a storage capacitor. A gate electrode of the first transistor is coupled to a first scan signal, a first electrode of the first transistor is coupled to a power supply voltage, and a second electrode of the first transistor is coupled to a first electrode of the storage capacitor. In addition, a gate electrode of the second transistor is coupled to the first scan signal, a first electrode of the second transistor is coupled to a data signal, and a second electrode of the second transistor is coupled to a gate electrode of the third transistor. A first electrode of the third transistor is coupled to the power supply voltage, and a second electrode of the third transistor is coupled to a first electrode of the fifth transistor. Furthermore, a gate electrode of the fourth transistor is coupled to a second scan signal, a first electrode of the fourth transistor is coupled to the gate electrode of the third transistor, and a second electrode of the fourth transistor is coupled to the first electrode of the storage capacitor, and a gate electrode of the fifth transistor is coupled to a light emitting signal, and a second electrode of the fifth transistor is coupled to a first electrode of the OLED. In addition, a second electrode of the storage capacitor is coupled to the first electrode of the fifth transistor, and a second electrode of the OLED is coupled to a low-level signal and emits light based on a drive current generated by the third transistor.

Another inventive aspect is a display panel, including an OLED pixel compensation circuit, configured to drive an Organic Light Emitting Diode (OLED) to emit light The OLED pixel compensation circuit includes first, second, third, fourth, and fifth transistors, and a storage capacitor. A gate electrode of the first transistor is coupled to a first scan signal, a first electrode of the first transistor is coupled to a power supply voltage, and a second electrode of the first transistor is coupled to a first electrode of the storage capacitor. In addition, a gate electrode of the second transistor is coupled to the first scan signal, a first electrode of the second transistor is coupled to a data signal, and a second electrode of the second transistor is coupled to a gate electrode of the third transistor. A first electrode of the third transistor is coupled to the power supply voltage, and a second electrode of the third transistor is coupled to a first electrode of the fifth transistor. Furthermore, a gate electrode of the fourth transistor is coupled to a second scan signal, a first electrode of the fourth transistor is coupled to the gate electrode of the third transistor, and a second electrode of the fourth transistor is coupled to the first electrode of the storage capacitor, and a gate electrode of the fifth transistor is coupled to a light emitting signal, and a second electrode of the fifth transistor is coupled to a first electrode of the OLED. In addition, a second electrode of the storage capacitor is coupled to the first electrode of the fifth transistor, and a second electrode of the OLED is coupled to a low-level signal and emits light based on a drive current generated by the third transistor.

Another inventive aspect is a display device, including an OLED pixel compensation circuit configured to drive an Organic Light Emitting Diode (OLED) to emit light The OLED pixel compensation circuit includes first, second, third, fourth, and fifth transistors, and a storage capacitor. A gate electrode of the first transistor is coupled to a first scan signal, a first electrode of the first transistor is coupled to a power supply voltage, and a second electrode of the first transistor is coupled to a first electrode of the storage capacitor. In addition, a gate electrode of the second transistor is coupled to the first scan signal, a first electrode of the second transistor is coupled to a data signal, and a second electrode of the second transistor is coupled to a gate electrode of the third transistor. A first electrode of the third transistor is coupled to the power supply voltage, and a second electrode of the third transistor is coupled to a first electrode of the fifth transistor. Furthermore, a gate electrode of the fourth transistor is coupled to a second scan signal, a first electrode of the fourth transistor is coupled to the gate electrode of the third transistor, and a second electrode of the fourth transistor is coupled to the first electrode of the storage capacitor, and a gate electrode of the fifth transistor is coupled to a light emitting signal, and a second electrode of the fifth transistor is coupled to a first electrode of the OLED. In addition, a second electrode of the storage capacitor is coupled to the first electrode of the fifth transistor, and a second electrode of the OLED is coupled to a low-level signal and emits light based on a drive current generated by the third transistor.

DETAILED DESCRIPTION OF THE PREFERRED EMBODIMENTS

To make the above object, features and advantages of the disclosure more obvious and easy to be understood, in the following, particular embodiments of the disclosure will be illustrated in detail in conjunction with the drawings.

More specific details will be set forth in the following descriptions for fully understanding of the disclosure, however the disclosure can also be implemented by other ways different from the way described herein, and therefore the disclosure is not limited to particular embodiments disclosed hereinafter.

Figure 1:
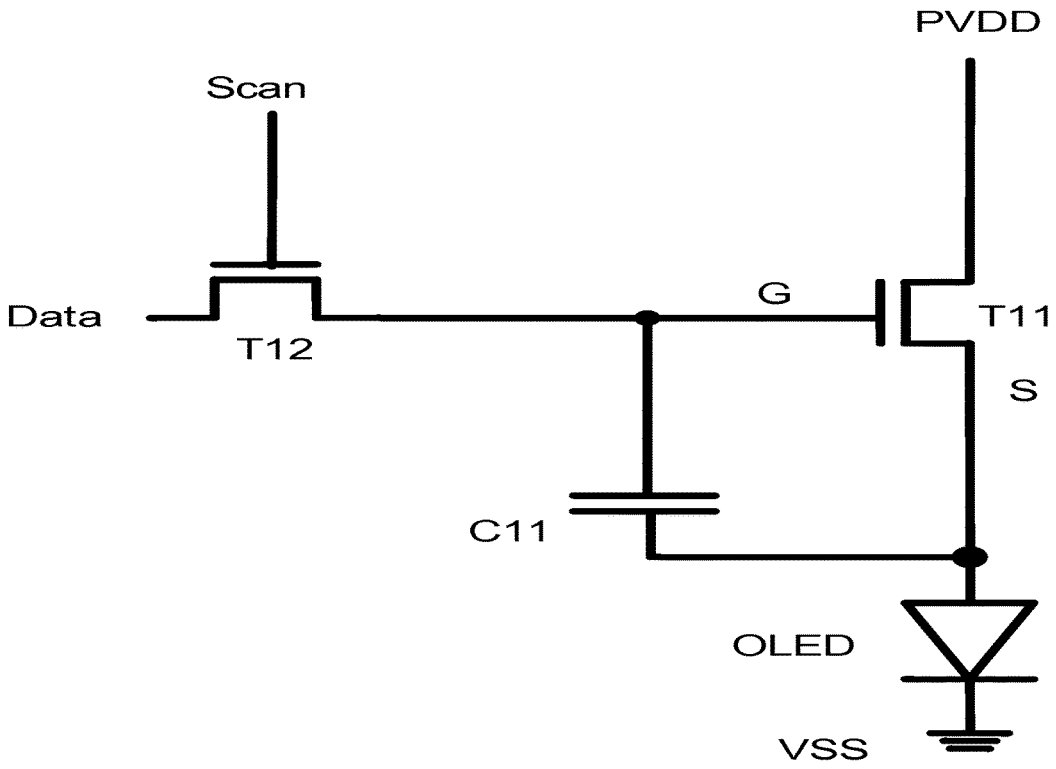
FIG. 1 is an OLED pixel driving circuit in the related art.
Figure 2A:
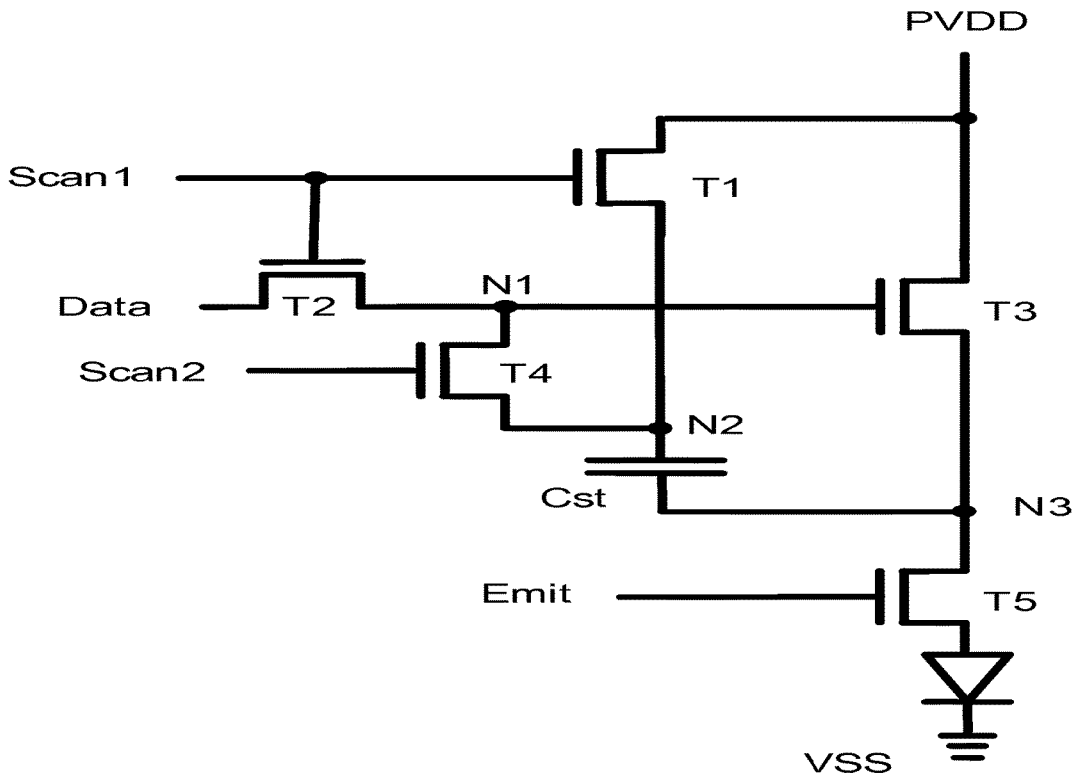
FIG. 2*a* is an OLED pixel compensation circuit according to an embodiment of the present disclosure.
Figure 2B:
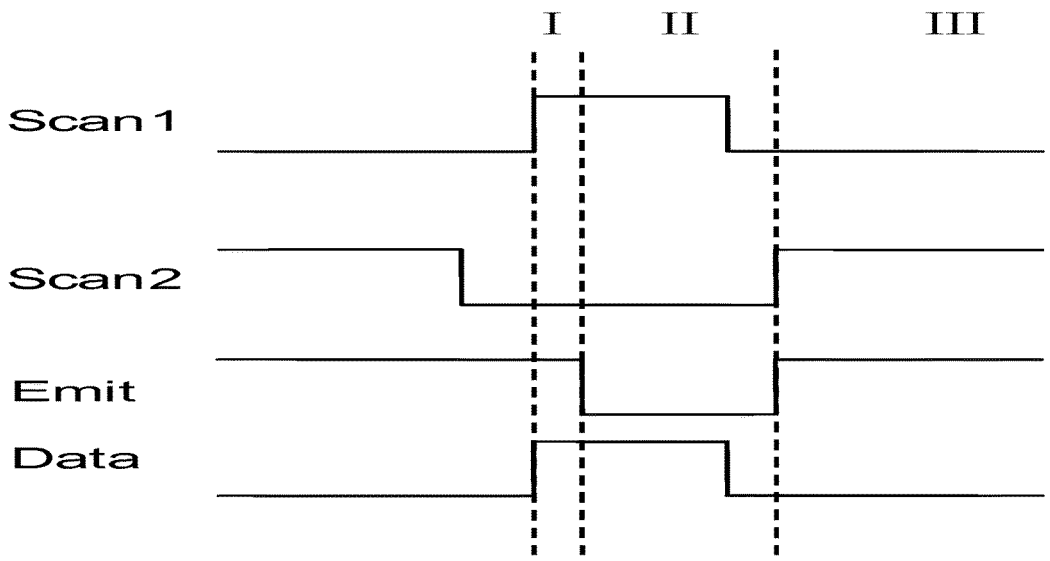
FIG. 2*b* is a timing diagram of the circuit shown in FIG. 2*a;*

Reference is made to FIGS. 2*a* and 2*b*. FIG. 2*a* is an OLED pixel compensation circuit according to an embodiment of the present disclosure, which is for driving the OLED to emit light. The OLED pixel compensation circuit comprises a first transistor T1, a second transistor T2, a third transistor T3, a fourth transistor T4, a fifth transistor T5 and a storage capacitor Cst. A gate electrode of the first transistor T1 is coupled to a first scan signal Scan1, a first electrode of the first transistor T1 is coupled to a power supply voltage PVDD, and a second electrode of the first transistor T1 is coupled to a first electrode of the storage capacitor Cst. A gate electrode of the second transistor T2 is coupled to the first scan signal Scan1, a first electrode of the second transistor T2 is coupled to a data signal Data, and a second electrode of the second transistor T2 is coupled to a gate electrode of the third transistor T3. A first electrode of the third transistor T3 is coupled to the power supply voltage PVDD, and a second electrode of the third transistor T3 is coupled to a first electrode of the fifth transistor T5. A gate electrode of the fourth transistor T4 is coupled to a second scan signal Scan2, a first electrode of the fourth transistor T4 is coupled to the gate electrode of the third transistor T3, and a second electrode of the fourth transistor T4 is coupled to the first electrode of the storage capacitor Cst. A gate electrode of the fifth transistor T5 is coupled to a light emitting signal Emit, and a second electrode of the fifth transistor T5 is coupled to a first electrode of the OLED; a second electrode of the storage capacitor Cst is coupled to the first electrode of the fifth transistor T5; and a second electrode of the OLED is coupled to a low-level signal VSS and emits light according to a drive current generated by the third transistor T3.

Optionally, the first electrode of the OLED may be an anode of the OLED. The second electrode of the OLED may be a cathode of the OLED. And the "coupling" herein may be a direct connection or an indirect connection.

Specifically, the first transistor T1 is for transferring the power supply voltage PVDD to the first electrode of the storage capacitor Cst under the control of the first scan signal Scan1. The second transistor T2 is for transferring the data signal Data to the gate electrode of the third transistor T3 under the control of the first scan signal Scan 1. The third transistor T3 is for generating the drive current under the control of the power supply voltage PVDD and a gate voltage of the third transistor T3. The fourth transistor T4 is for transferring the data signal Data received by the first electrode of the fourth transistor to the first electrode of the storage capacitor Cst under the control of the second scan signal Scan2. The fifth transistor T5 is for transferring a voltage of the first electrode of the fifth transistor T5 to the second electrode of the fifth transistor T5 under the control of the light emitting signal Emit. And the storage capacitor Cst is for storing the received voltage and coupling a change value of a voltage on the second electrode of the storage capacitor Cst to the first electrode of the storage capacitor Cst.

In the following, a specific working process and a working principle are described.

Referring to FIGS. 2*a* and 2*b*, all transistors in the OLED pixel compensation circuit are N-type Mental Oxide Semiconductor (NMOS) transistors. Therefore, the first electrode of the transistor may be a drain electrode and the second electrode of the transistor may be a source electrode. Driving of the OLED pixel compensation circuit may comprise a first stage, a second stage and a third stage. And the first stage is a reset stage of the circuit, for initializing the circuit.

Specifically, in the first stage, since the second scan signal Scan2 is output as a low-level signal, the fourth transistor T4 is switched off. Since the first scan signal Scan1 is output as a high-level signal, the first transistor T1 and the second transistor T2 are switched on, the power supply voltage PVDD is written in a node N2 (the node N2 is an intersection of the second electrode of the first transistor T1, the second electrode of the fourth transistor T4 and the first electrode of the storage capacitor Cst) through the first transistor T1, and VN2=PVDD. A voltage of the data signal Data, Vdata, is written in a node N1 (the node N1 is an intersection of the second electrode of the second transistor T2, the gate electrode of the third transistor T3 and the first electrode of the fourth transistor T4) through the second transistor T2, and VN1=Vdata. Since the data signal Data in the first stage is a high-level signal, the third transistor T3 is switched on under the control of the high-potential Vdata. Since the light emitting signal Emit is output as a high-level signal, the fifth transistor T5 is switched on, the OLED emits light for a while within the stage, and the potential of a node N3 (an intersection of the second electrode of the third transistor T3, the first electrode of the fifth transistor T5 and the second electrode of the storage capacitor Cst) is VN3=VSS+Vo, with Vo being a voltage drop on the OLED.

The second stage is a threshold compensation stage of a driving transistor (the third transistor T3 in the present embodiment) in the circuit, for capturing a threshold voltage Vth of the third transistor. Specifically, in the second stage, the fourth transistor T4 is switched off since the second scan signal Scan2 is output as a low-level signal. The fifth transistor T5 is switched off since the light emitting signal Emit is a low-level signal. The first scan signal Scan 1 is output as a high-level signal, therefore, the first transistor T1 and the second transistor T2 are switched on, the power supply voltage PVDD is written into the node N2 through the first transistor T1 and VN2=PVDD. The voltage of the data signal Data, Vdata, is written into the node N1, and VN1=Vdata. In the second stage, under the control of the high-potential Vdata, the third transistor T3 is switched on, the node N3 is charged by the power supply voltage PVDD through the third transistor T3 which has been switched on, until the voltage VN3 of the node N3 meets the equation that VN3=Vdata−Vth, and as a result, the third transistor T3 is switched off. Vth is the threshold voltage of the third transistor T3, and in the case that VN3=Vdata−Vth, a voltage across the gate electrode of the third transistor (the driving transistor) and the second electrode of the third transistor (i.e. a gate-source voltage of the third transistor T3) is no longer larger than 0, that is, a condition for the third transistor to be switched on is not met, therefore, the third transistor T3 is switched off, and the threshold compensation stage is ended. In this case, a difference between voltages on two ends of the storage capacitor Cst is VN2−VN3=PVDD−Vdata+Vth.

The third stage is a light emitting stage of the circuit, for driving the OLED to emit light. Specifically, in the third stage, the first transistor T1 and the second transistor T2 are switched off since the first scan signal Scan1 is a low-level signal. Since the second scan signal Scan2 and the light emitting signal Emit are both output as high-level signals in the stage, the fourth transistor T4 and the fifth transistor T5 are switched on, the storage capacitor Cst is connected between the gate electrode and the source electrode (i.e. between the gate electrode and the second electrode) of the third transistor T3, and since charges stored in the storage capacitor Cst are kept unchanged, the gate-source voltage of the driving transistor, i.e. the gate-source voltage of the third transistor, Vgs, is maintained, and the third transistor T3 is switched on. With the drive current generated by the OLED tends to be stable, assuming that VSS=0V, a potential of the node N3 on one end of the OLED is changed to Voled (Voled is the voltage drop on the OLED). Due to a bootstrap effect of the storage capacitor Cst, in the case that the voltage difference between the two ends of the storage capacitor Cst is not changed, the voltage of the node N2, i.e. N1 in this case, on the other end of the storage capacitor Cst is changed into PVDD−Vdata+Vth+Voled. The drive current Ioled for driving the OLED to emit light which passes through the third transistor T3 is directly proportional to a square of a difference value between the gate-source voltage (a voltage across the gate electrode and the second electrode) of the driving transistor, i.e. the third transistor T3, and the threshold voltage of the third transistor T3, that is, Ioled∝(Vgs−Vth)2. Therefore, Ioled∝(Vgs−Vth)2=(Vg−Vs−Vth)2=((PVDD−Vdata+Vth+Voled)−Voled−Vth)2=(PVDD−Vdata)2. It can be seen from the above that, the drive current of the OLED is independent of the threshold voltage of the driving transistor T3; hence the threshold voltage of the driving transistor T3 is compensated.

In the above stage, since the second transistor T2 is switched off, the data signal Data may be a high-level signal or a low-level signal, which is not limited herein.

With the OLED pixel compensation circuit according to the present embodiment, an influence of the threshold voltage of the driving transistor (the third transistor T3 in the present embodiment) on the generated drive current may be counteracted and the threshold voltage of the driving transistor is compensated. Thereby the drive current generated by the driving transistor does not deviate, and a display quality of an OLED panel is improved.

Figure 3A:
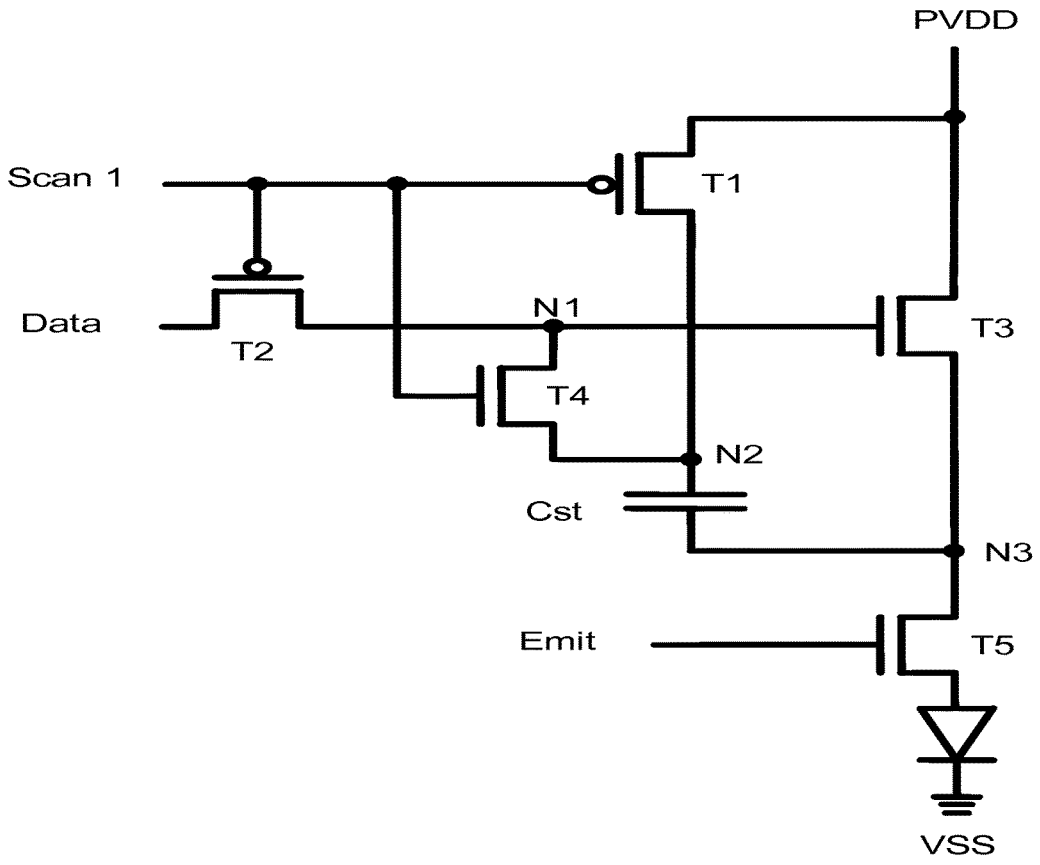
FIG. 3*a* is another OLED pixel compensation circuit according to an embodiment of the present disclosure.
Figure 3B:
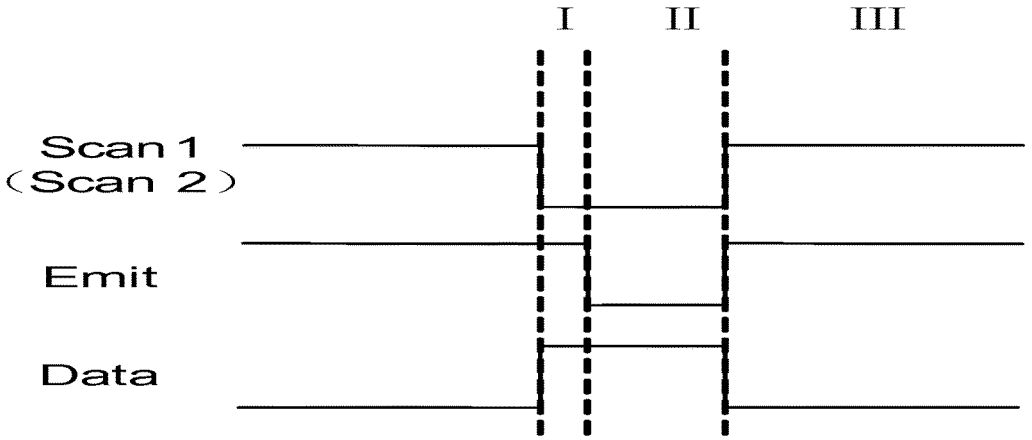
FIG. 3*b* is a timing diagram of the circuit shown in FIG. 3*a*.

Referring to FIGS. 3*a* and 3*b*, an embodiment is obtained based on the embodiment mentioned above, as shown in FIG. 2*a* and FIG. 2*b*. A difference between the present embodiment and the embodiment mentioned above is that: in the present embodiment, a first transistor T1 and a second transistor T2 are P-type Mental Oxide Semiconductor (PMOS) transistors, and first electrodes of the PMOS transistors are source electrodes and second electrodes of the PMOS transistors are drain electrodes. Correspondingly, levels in the three stages in driving the OLED pixel, accordingly to vary as follows.

In the first stage (the reset stage), the first scan signal Scan1 is a low-level signal, the light emitting signal Emit is a high-level signal, and the data signal Data is a high-level signal.

In the second stage (the threshold compensation stage), the first scan signal Scan1 is a low-level signal, the light emitting signal Emit is a low-level signal, and the data signal Data is a high-level signal; and In the third stage (the light emitting stage), the first scan signal Scan1 is a high-level signal and the light emitting signal Emit is a high-level signal. It should be noted that, since the second transistor T2 is switched off in this stage, the data signal Data in this stage may be a high-level signal or a low-level signal.

It can be seen from the signal timing sequence that, in the case that the first transistor T1 and the second transistor T2 are PMOS transistors, a signal for driving the first transistor T1 and the second transistor T2 may be maintained consistent with a signal for driving the fourth transistor T4, that is, the second scan signal Scan 2 may be the same as the first scan signal Scan1. Hence, one signal drive source and a trace corresponding to the signal drive source may be reduced in the OLED pixel driving circuit. Meanwhile, since a specific implementation process and a working principle in the present embodiment are similar to that in the embodiment as shown in FIG. 2*a* and FIG. 2*b*, only because transistor types of the first transistor T1 and the second transistor T2 are changed from NMOS transistors into PMOS transistors, hence a level of a corresponding drive signal (the first scan signal Scan1) is also reversed. By the present embodiment, threshold voltage of the driving transistor (the third transistor T3 herein) may be also compensated and the display effect is improved, since no changes or influences on other signals or circuit structures is generated. The specific detail of the working mode may be understood by referring to the embodiment as shown in FIG. 2*a* and FIG. 2*b*, and will not be described hereinafter.

It should be noted that, in the above embodiments, it is taken as an example that the fourth transistor T4 is a NMOS transistor. In practice, the fourth transistor may be also a PMOS transistor, and correspondingly, it is necessary to reverse the level of the drive signal, i.e. the second scan signal Scan 2, in the three stages. Similarly, the fifth transistor T5 may be also a PMOS transistor, and it is also necessary to correspondingly reverse the level of the drive signal, i.e. the light emitting signal Emit, in the three stages.

The present disclosure further provides a display panel comprising the OLED pixel compensation circuit according to any one of the above embodiments.

The present disclosure further correspondingly provides a display device comprising the OLED pixel compensation circuit according to any one of the above embodiments, or including the above display panel.

The display panel or display device is capable of counteracting the influence of the threshold voltage of the driving transistor (the third transistor T3) on the generated drive current and compensates the threshold voltage of the driving transistor, since it comprises the OLED pixel compensation circuit according to the above embodiments. As a result, the drive current generated by the driving transistor does not deviate and the display quality of the OLED panel is improved.

It should be noted that, the above embodiments may make reference to each other, and may be used synthetically.

Though the present disclosure is disclosed by way of preferred embodiments as described above, those embodiments are not intended to limit the present disclosure. By using the methods and the technical aspects disclosed above, possible variations and changes may be made to the technical scheme of the present disclosure by any skilled in the art without departing from the essential and the scope of the present disclosure. Therefore, any simple change, equivalent alternation and modification made to the above embodiments according to the technical principle of the present disclosure, which do not depart from the contents of the technical scheme of the present disclosure, all fall within the scope of protection of the technical scheme of the present disclosure.

What is claimed is:

1. An Organic Light Emitting Diode (OLED) pixel compensation circuit, configured to drive an OLED to emit light, the OLED pixel compensation circuit comprising:

first, second, third, fourth, and fifth transistors; and a storage capacitor, wherein a gate electrode of the first transistor is directly electrically connected to a first scan signal, a first electrode of the first transistor is directly electrically connected to a power supply voltage, and a second electrode of the first transistor is directly electrically connected to a first electrode of the storage capacitor, wherein a gate electrode of the second transistor is directly electrically connected to the first scan signal, a first electrode of the second transistor is directly electrically connected to a data signal, and a second electrode of the second transistor is directly electrically connected to a gate electrode of the third transistor, wherein a first electrode of the third transistor is directly electrically connected to the power supply voltage, and a second electrode of the third transistor is directly electrically connected to a first electrode of the fifth transistor, wherein a gate electrode of the fourth transistor is directly electrically connected to a second scan signal, a first electrode of the fourth transistor is directly electrically connected to the gate electrode of the third transistor, and a second electrode of the fourth transistor is directly electrically connected to the first electrode of the storage capacitor, and the fourth transistor is configured to transfer the data signal received by the first electrode of the fourth transistor to the first electrode of the storage capacitor in response to the second scan signal, wherein a gate electrode of the fifth transistor is directly electrically connected to a light emitting signal, and a second electrode of the fifth transistor is directly electrically connected to a first electrode of the OLED, wherein a second electrode of the storage capacitor is directly electrically connected to the first electrode of the fifth transistor, and wherein a second electrode of the OLED is directly electrically connected to a low-level signal and emits light based on a drive current generated by the third transistor.

2. The circuit according to claim 1, wherein:

the first transistor is configured to transfer the power supply voltage to the first electrode of the storage capacitor in response to the first scan signal;

the second transistor is configured to transfer the data signal to the gate electrode of the third transistor in response to the first scan signal;

the third transistor is configured to generate the drive current in response to the power supply voltage and a gate voltage of the third transistor;

the fifth transistor is configured to transfer a voltage of the first electrode of the fifth transistor to the second electrode of the fifth transistor in response to the light emitting signal; and the storage capacitor is configured to store a received voltage and couple a change value of a voltage on the second electrode of the storage capacitor to the first electrode of the storage capacitor.

3. The circuit according to claim 1, wherein the third transistor, the fourth transistor and the fifth transistor are N-type Metal Oxide Semiconductor (NMOS) transistors.

4. The circuit according to claim 3, wherein the first transistor and the second transistor are NMOS transistors or are P-type Metal Oxide Semiconductor (PMOS) transistors.

5. The circuit according to claim 4, wherein the first transistor and the second transistor are PMOS transistors, and the second scan signal is the same as the first scan signal.

6. The circuit according to claim 4, wherein the first transistor and the second transistor are NMOS transistors, and a process of pixel compensation comprises a first stage, a second stage and a third stage, wherein:

during the first stage, the first scan signal is a high-level signal, the second scan signal is a low-level signal, the light emitting signal is a high-level signal, and the data signal is a high-level signal, during the second stage, the first scan signal is a high-level signal, the second scan signal is a low-level signal, the light emitting signal is a low-level signal, and the data signal comprises a high-level signal, during the third stage, the first scan signal is a low-level signal, the second scan signal is a high-level signal, and the light emitting signal is a high-level signal.

7. The circuit according to claim 5, wherein a process of pixel compensation comprises a first stage, a second stage and a third stage, wherein:

during the first stage, the first scan signal is a low-level signal, the light emitting signal is a high-level signal, and the data signal is a high-level signal, during the second stage, the first scan signal is a low-level signal, the light emitting signal is a low-level signal, and the data signal is a high-level signal, and during the third stage, the first scan signal is a high-level signal and the light emitting signal is a high-level signal.

8. The circuit according to claim 6, wherein the first stage is a reset stage of the circuit, and the circuit is reset during the first stage.

9. The circuit according to claim 7, wherein the first stage is a reset stage of the circuit, and the circuit is reset during the first stage.

10. The circuit according to claim 6, wherein the second stage is a threshold compensation stage of the third transistor in the circuit, and a threshold voltage of the third transistor is captured during the second stage.

11. The circuit according to claim 7, wherein the second stage is a threshold compensation stage of the third transistor in the circuit, and a threshold voltage of the third transistor is captured during the second stage.

12. The circuit according to claim 6, wherein the third stage is a light emitting stage of the circuit, and the OLED is driven to emit light during the third stage.

13. The circuit according to claim 7, wherein the third stage is a light emitting stage of the circuit, and the OLED is driven to emit light during the third stage.

14. A display panel, comprising an Organic Light Emitting Diode (OLED) pixel compensation circuit, configured to drive an OLED to emit light, the OLED pixel compensation circuit comprising:

first, second, third, fourth, and fifth transistors; and a storage capacitor, wherein a gate electrode of the first transistor is directly electrically connected to a first scan signal, a first electrode of the first transistor is directly electrically connected to a power supply voltage, and a second electrode of the first transistor is directly electrically connected to a first electrode of the storage capacitor, wherein a gate electrode of the second transistor is directly electrically connected to the first scan signal, a first electrode of the second transistor is directly electrically connected to a data signal, and a second electrode of the second transistor is directly electrically connected to a gate electrode of the third transistor, wherein a first electrode of the third transistor is directly electrically connected to the power supply voltage, and a second electrode of the third transistor is directly electrically connected to a first electrode of the fifth transistor, wherein a gate electrode of the fourth transistor is directly electrically connected to a second scan signal, a first electrode of the fourth transistor is directly electrically connected to the gate electrode of the third transistor, and a second electrode of the fourth transistor is directly electrically connected to the first electrode of the storage capacitor, and the fourth transistor is configured to transfer the data signal received by the first electrode of the fourth transistor to the first electrode of the storage capacitor in response to the second scan signal, wherein a gate electrode of the fifth transistor is directly electrically connected to a light emitting signal, and a second electrode of the fifth transistor is directly electrically connected to a first electrode of the OLED, wherein a second electrode of the storage capacitor is directly electrically connected to the first electrode of the fifth transistor, and wherein a second electrode of the OLED is directly electrically connected to a low-level signal and emits light based on a drive current generated by the third transistor.

15. The display panel according to claim 14, wherein:

the first transistor is configured to transfer the power supply voltage to the first electrode of the storage capacitor in response to the first scan signal;

the second transistor is configured to transfer the data signal to the gate electrode of the third transistor in response to the first scan signal;

the third transistor is configured to generate the drive current in response to the power supply voltage and a gate voltage of the third transistor;

the fifth transistor is configured to transfer a voltage of the first electrode of the fifth transistor to the second electrode of the fifth transistor in response to the light emitting signal; and the storage capacitor is configured to store a received voltage and couple a change value of a voltage on the second electrode of the storage capacitor to the first electrode of the storage capacitor.

16. The display panel according to claim 14, wherein the third transistor, the fourth transistor and the fifth transistor are N-type Metal Oxide Semiconductor (NMOS) transistors.

17. The display panel according to claim 16, wherein the first transistor and the second transistor are NMOS transistors or are P-type Metal Oxide Semiconductor (PMOS) transistors.

18. A display device, comprising an Organic Light Emitting Diode (OLED) pixel compensation circuit configured to drive an OLED to emit light, the OLED pixel compensation circuit comprising:

first, second, third, fourth, and fifth transistors; and a storage capacitor, wherein a gate electrode of the first transistor is directly electrically connected to a first scan signal, a first electrode of the first transistor is directly electrically connected to a power supply voltage, and a second electrode of the first transistor is directly electrically connected to a first electrode of the storage capacitor, wherein a gate electrode of the second transistor is directly electrically connected to the first scan signal, a first electrode of the second transistor is directly electrically connected to a data signal, and a second electrode of the second transistor is directly electrically connected to a gate electrode of the third transistor, wherein a first electrode of the third transistor is directly electrically connected to the power supply voltage, and a second electrode of the third transistor is directly electrically connected to a first electrode of the fifth transistor, wherein a gate electrode of the fourth transistor is directly electrically connected to a second scan signal, a first electrode of the fourth transistor is directly electrically connected to the gate electrode of the third transistor, and a second electrode of the fourth transistor is directly electrically connected to the first electrode of the storage capacitor, and the fourth transistor is configured to transfer the data signal received by the first electrode of the fourth transistor to the first electrode of the storage capacitor in response to the second scan signal, wherein a gate electrode of the fifth transistor is directly electrically connected to a light emitting signal, and a second electrode of the fifth transistor is directly electrically connected to a first electrode of the OLED, wherein a second electrode of the storage capacitor is directly electrically connected to the first electrode of the fifth transistor, and wherein a second electrode of the OLED is directly electrically connected to a low-level signal and emits light based on a drive current generated by the third transistor.

19. The display device according to claim 18, wherein:

the first transistor is configured to transfer the power supply voltage to the first electrode of the storage capacitor in response to the first scan signal;

the second transistor is configured to transfer the data signal to the gate electrode of the third transistor in response to the first scan signal;

the third transistor is configured to generate the drive current in response to the power supply voltage and a gate voltage of the third transistor;

the fifth transistor is configured to transfer a voltage of the first electrode of the fifth transistor to the second electrode of the fifth transistor in response to the light emitting signal; and the storage capacitor is configured to store a received voltage and couple a change value of a voltage on the second electrode of the storage capacitor to the first electrode of the storage capacitor.

20. The display device according to claim 19, wherein the third transistor, the fourth transistor and the fifth transistor are N-type Metal Oxide Semiconductor (NMOS) transistors.

* * * * *